United States Patent [19]

Imhoff

[11] 4,429,492

[45] Feb. 7, 1984

[54] DOOR COORDINATOR

[75] Inventor: William B. Imhoff, Springdale, Conn.

[73] Assignee: Leigh Products, Inc., New Haven, Conn.

[21] Appl. No.: 422,169

[22] Filed: Sep. 23, 1982

Related U.S. Application Data

[63] Continuation-in-part of Ser. No. 342,750, Jan. 26, 1982, abandoned.

[51] Int. Cl.[3] ..... E05C 7/05

[52] U.S. Cl. ..... 49/367; 16/82

[58] Field of Search ..... 49/367, 368, 369, 366, 49/3; 16/82

[56] References Cited

U.S. PATENT DOCUMENTS

| | | | |
|---|---|---|---|
| Re. 29,107 | 1/1977 | Imhoff | 16/82 |
| 2,015,996 | 10/1935 | Eichacker | 49/366 |
| 3,822,506 | 7/1974 | Fischbach | 49/367 |
| 3,895,461 | 7/1975 | Maynard, Jr. et al. | 49/367 |

*Primary Examiner*—Philip C. Kannan

*Attorney, Agent, or Firm*—Costas, Montgomery & Dorman

[57] ABSTRACT

A door closing coordinator for a pair of oppositely hinged doors where closure of the inactive door withdraws a stopping member from a holding lever for the active door and permits the active door to close after the inactive door. An override mechanism is provided to permit the active door to close first if a predetermined force is applied thereto to avoid damage to the active door.

8 Claims, 8 Drawing Figures

DOOR COORDINATOR

REFERENCE TO PRIOR APPLICATION

This is a continuation-in-part of application Ser. No. 06/342,750, filed Jan. 26, 1982, now abandoned.

FIELD OF THE INVENTION

This invention relates to a door coordinator for controlling the sequential closing of a pair of oppositely hinged swinging doors in which one is an active door and the other is an inactive door.

BACKGROUND OF THE INVENTION

In many installations, pairs of doors are utilized which are hinged to a door opening or frame at the outside edges thereof. The active door, in which a central latch is installed, is normally used in passing through the door opening. The inactive door, which contains a strike for the center latch, is normally held closed by top and bottom bolts. To ensure proper clearance of an astragal, which may be mounted on either or both doors, or of other hardware devices, a door closing coordinator is required. The coordinator holds the active door open until the inactive door reaches a closing position. Such door coordinators may comprise a pair of arms extending from a common pivot such that the active door is held open until the inactive door pivots the arms upwardly to allow the active door to close. Such an arrangement is shown in U.S. Pat. Re. 29107, assigned to the same Assignee as this patent.

Other types of door coordinators, as shown in U.S. Pat. Nos. 3,822,506 and 3,895,461, provide the proper closing sequence by utilizing a holding member, for the active door, that is blocked by a rod which is released by a trigger or lever upon being struck by the inactive door.

The present invention relates to door coordinators of the latter type, and provides a new, improved, and more durable construction, and further includes an override feature for closing the active door prior to the inactive door, upon application of a force exceeding a predetermined level, so as to prevent damage to the door and/or the door coordinator. In some forms of the invention, provision is made for cooperation with various top latch devices.

SUMMARY OF THE INVENTION

Briefly stated, the invention, in one form thereof, comprises a housing member which is mounted to the horizontal frame of a doorway to which are hinged active and inactive doors. A first holding lever is pivotally mounted in the housing adjacent the hinged side of the active door to hold the active door open until the inactive door closes. A second lever, in the form of a bell crank, is pivotally mounted in the housing in position to be engaged by the inactive door adjacent the free end thereof. A stopping rod is pivotally connected to an arm of the second lever and extends to a position to prevent inward movement of the holding lever until the inactive door closes and withdraws the rod from the prevent position. A slide member having a predetermined bias thereon is positioned in the housing in contact with the free end of the rod to normally prevent movement of the rod toward the second lever. The free end of the rod has engagement with the holding lever, such that when sufficient force is applied to the holding lever, it will force the rod toward the second lever over the bias of the slide member and permit the active door to first close if sufficient force is applied thereto.

In some forms of the invention, adapted for use with top latch devices, the stopping rod includes a pair of rod blocks slidably carried in the housing and rigidly connected by an offset rod connector. The rod connector is disposed so as to permit the provision, in the housing member, of unobstructed cut-outs or openings for the receipt of bolts or similar door latching members.

The features of the invention which are believed to be novel are particularly pointed out and distinctly claimed in the concluding portion of the specification. The invention, however, together with objects and advantages thereof, may best be appreciated by reference to the following detailed description taken in conjunction with the drawings.

DETAILED DESCRIPTION OF THE PREFERRED AND ILLUSTRATED EMBODIMENTS

Figures 1, 2, 3, 4, 5:
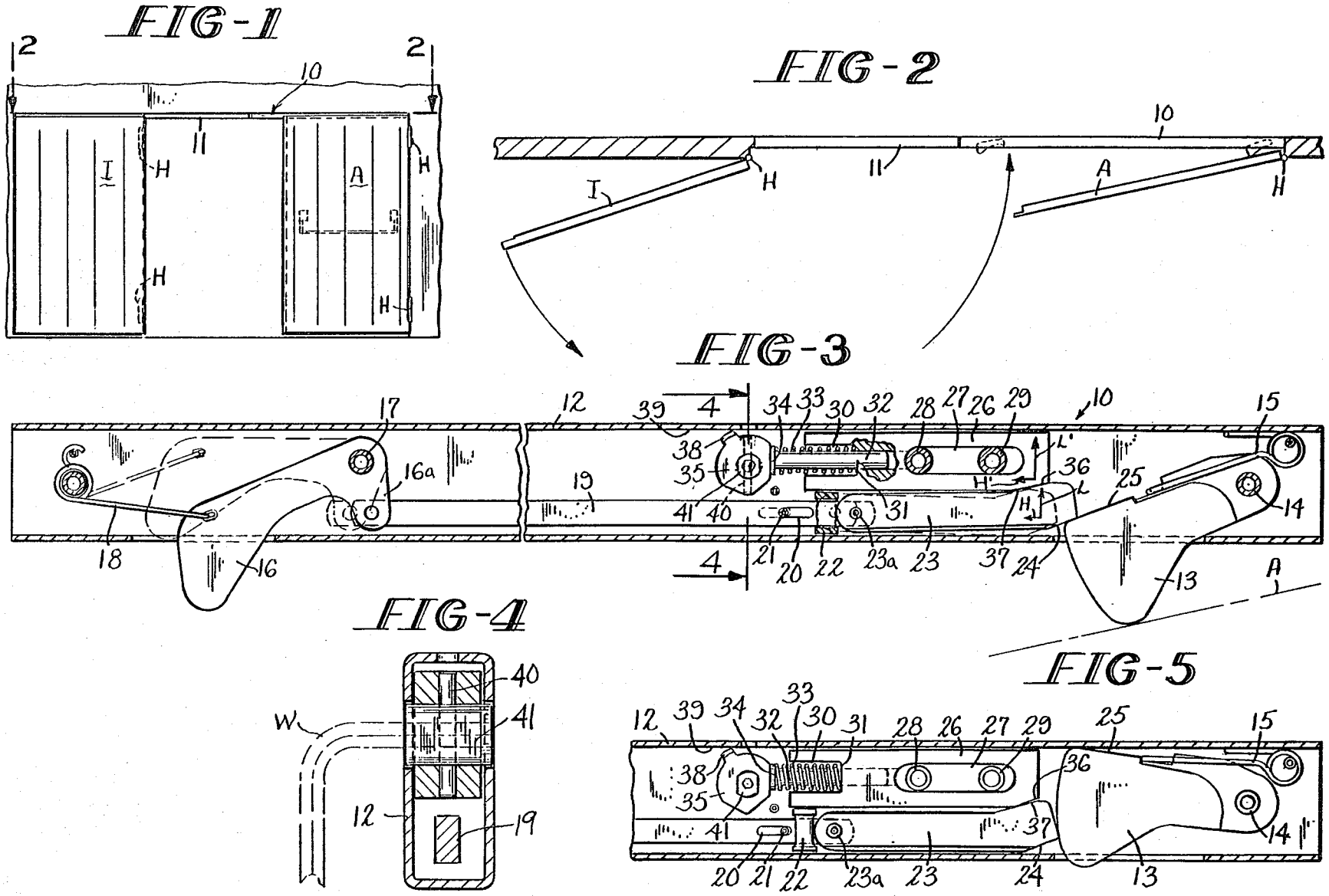
FIG. 1 is a front elevation of a door frame showing an active door in the hold open position and an inactive door in the open position.
FIG. 2 is a sectional view seen in the plane of lines 2—2 of FIG. 1.
FIG. 3 is a longitudinal sectional view through a first coordinator system embodying the invention, showing the holding member for the active door in a door engaging position.
FIG. 4 is a sectional view seen in the plane of lines 4—4 of FIG. 3.
FIG. 5 is a view in portions similar to FIG. 3, showing the active door holding member in the override position.

As illustrated in FIGS. 1 and 2, a door coordinator 10 embodying the invention is adapted to be mounted along the header of a door frame and may include a spacer element 11. An active door A and an inactive door I are oppositely hinged at H to the door frame.

As best seen in FIG. 3, the system comprises a housing 12 of generally rectangular cross-section. Pivotally mounted in the housing is an active door holding lever 13 about a pivot pin 14. A spring 15 biases the holding lever towards an extended position, as illustrated in FIG. 3. The holding lever 13 is positioned adjacent the hinged end of active door A. An actuating or second lever 16 is pivotally mounted in housing 12 about a pin 17 in a position to be engaged by the free end of inactive door I. A spring 18 biases lever 16 toward an extended position. Lever 16 is in the form of a bell crank having arm or lug **16*a***.

In one embodiment of the invention, shown in FIGS. 3 and 5, a rod 19 is pivotally attached to end **16*a*. Rod 19 has a longitudinal slot 20 defined therein which receives a guide pin 21 to ensure linear movement of rod 19. A further guide member 22 receives rod 19. Pivotally connected to the end of rod 19 is a further rod member 23 having a beveled or angled surface 24 which is in surface contact with surface 25 of holding lever 13 and acts as a stopping member with respect to lever 13. A slide member 26 which is biased to predetermine force to override the sequential closing of the doors is disposed within housing 11 and has a longitudinal slot 27 defined therein encompassing guide pins 28 and 29. Slide member 26 has a recess 30 defined therein defining a spring seat 31 and receives a pin 32 about which is disposed a biasing spring 33. Spring 33 at its other end rests against the head 34 of pin 32. The head 34 of pin 32 bears against a surface of a bias-adjusting cam member 35. Spring 33 acting on spring seat 31 biases slide member 26 to the right as shown in FIG. 3. Slide member 26 has a beveled or angled surface 36 on a side towards the free end thereof which engages angled surface 37 of rod 23**.

Figure 6:
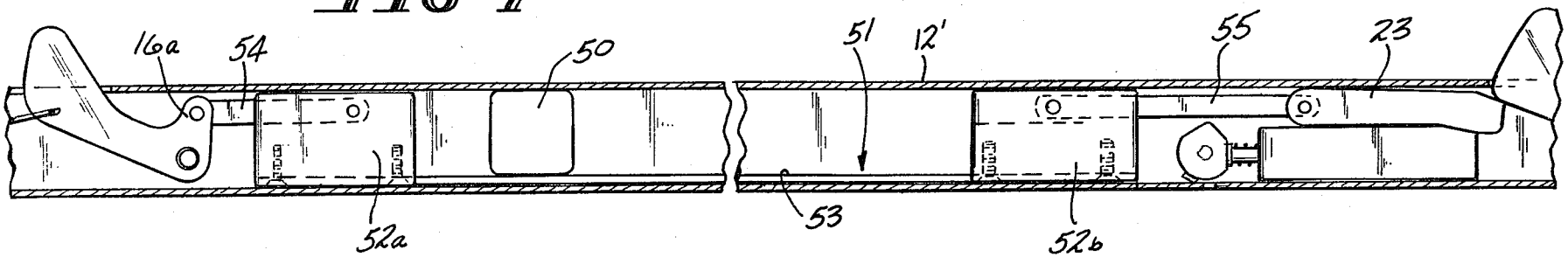
FIG. 6 is a fragmentary longitudinal sectional view through a second coordinator system embodying the invention, showing the use of rod blocks and an offset rod connector to provide a latching member cut-out.

In FIG. 6, there is illustrated a second embodiment of the present invention, wherein housing 12' is provided with a cut-out or opening 50 adapted to receive the bolts or similar members (not shown) of top latch devices carried by the doors. In place of a rod 19, the door coordinator of this embodiment utilizes a rod assembly 51 so as to prevent obstruction of opening 50. Rod assembly 51 includes a pair of rod blocks **52*a*, 52*b* slidably carried in housing 12, one on either side of opening 50, connected by an offset rod connector 53. Lever end 16*a* is pivotally connected to a trigger rod 54 which, in turn, is connected to rod block 52*a*. Likewise, rod 23 is pivotally connected to holding slide rod 55 which, in turn, is connected to rod block 52*b***.

Figure 8:
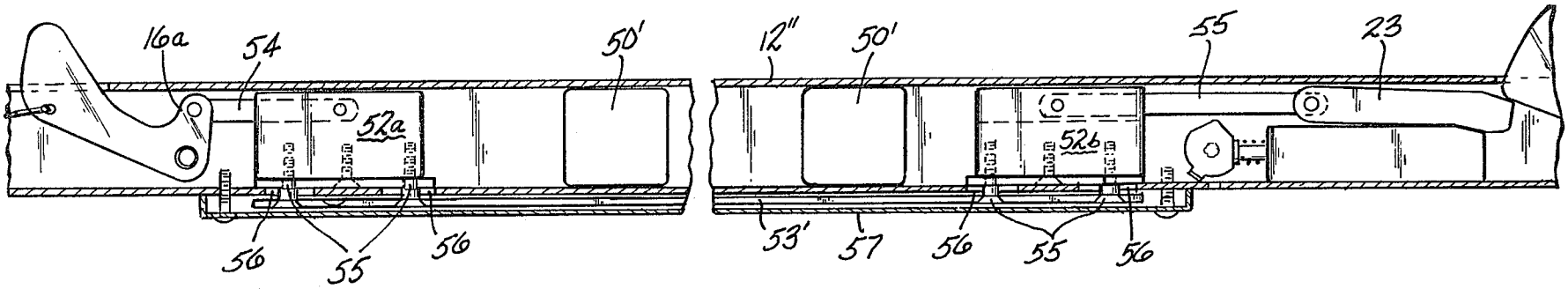
FIG. 8 is a view in portions similar to FIG. 6, showing an alternate arrangement of the rod blocks and rod connector.
Figure 7:
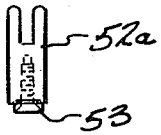
FIG. 7 is an end plan view of one of the rod blocks of FIG. 6.

In FIG. 8, there is illustrated a third embodiment differing from that previously described in that a rod connector 53' is disposed outside housing 12'' and is connected to rod blocks **52*a*, 52*b* by fasteners 55 which pass through slots 56 in the housing wall. It should be apparent that such a configuration makes possible wider unobstructed openings 50' than the arrangement of parts shown in FIG. 6. A removable cover 57 protects rod connector 53'**.

The operation and functioning of the present invention will now be described with specific reference to the embodiment of FIGS. 3 and 5, it being understood, however, that the embodiment of FIGS. 6 and 8 operate and function in like manner.

In normal operation of any of the described embodiments of the coordinator, when both doors are to be closed and the active door swings closed first, holding lever 13 will be in a hold open position by virtue of its contact with surface 24 of rod 23. However, when the inactive door is moved towards a closed position, it strikes lever 16, which moves to the position shown in broken line in FIG. 3, causing rod 19 to be retracted also, as shown in broken line in FIG. 3. This will permit holding lever 13 then to be pivoted by the active door A to a retracted position as shown in FIG. 5.

If under extraordinary conditions, the active door A is struck with a force above a predetermined magnitude, the holding lever may be forcibly retracted. The force exerted on holding lever 13 is transitted in coordinate components to rod 23 as exemplified by the arrows L and H. The component force L in turn causes rod 23 to exert coordinate components of force on slide 26 as represented by the arrows H' and L'. When the component force H' is of sufficient magnitude, slide 26 will move to the left as viewed in FIG. 3 as will the rod 23 permitting holding lever 13 to pivot to the retracted position as shown in FIG. 5.

Rod 23, while an extension of rod 19, is pivoted at **23*a* to permit movement in the direction transverse to the linear movement of rod 19 when the latter is retracted by lever 16**.

As shown, the cam bias adjustment member 35 has three flat and one curved surfaces all spaced radially differently from the axis of rotation of the adjustment member. Thus, four different, predetermined biases may be applied to slide 26 through spring 33. A tab 38 extending from camming member 35 will engage wall 39 of housing 12 to limit rotation of member 35. Member 35 is affixed, as by a pin 40, to a pivotal member 41 in housing 12. Member 41 has a socket therein adapted to receive a turning tool such as an Allen wrench W to adjust the bias on slide 26.

The present invention provides a new and improved door coordinator of long durability, yet relatively simple design which permits override of the normal sequential closing.

While preferred embodiments of the invention have been set forth for purposes of disclosure, other embodiments of the invention as well as modifications to the disclosed embodiments may occur to those skilled in the art. Accordingly, the appended claims are intended to cover all embodiments of the invention which do not depart from the spirit and scope thereof.

Having thus described the invention, what is claimed is:

1. A system for coordinating the closing of a pair of doors oppositely hinged to a frame, one door being active and the other inactive, comprising a housing member adapted to be mounted to the door frame, a first holding lever pivotally mounted to said housing adjacent one end thereof and extending from said housing to hold the active door open until the inactive door closes, a second lever pivotally mounted in said housing and positioned to be engaged by the inactive door adjacent the free end thereof, a rod having a free end pivotally connected to said second lever and extending to a position to prevent inward movement of said first lever whereby when the inactive door engages said second layer and pivots said second lever said rod is retracted from engagement with said holding lever to permit said active door to close, means biasing said second lever toward an extending position, a member slideable in said housing and in contact with the free end of said rod to normally prevent movement of said rod toward said second lever, and means biasing said member into engagement with the free end of said rod, said free end of said rod having engagement with said holding lever such that when sufficient force is appllied to said holding lever it will force said rod toward said second lever over the bias of said biasing means on said slideable member.

2. The system of claim 1, wherein said rod comprises pivotally connected first and second portions, said second portion having an angled end surface in contact with a surface of said holding lever, such that, when said holding lever is forced inwardly by the sufficient force, it imparts a linear force to said rod.

3. The system of claim 1, wherein the bias of said biasing means is variable.

4. The system of claim 1, where said slideable member and said free end of said rod have contact along a plane angled with respect to the direction of movement of said rod.

5. The system of claim 1, where said biasing means is a spring which bears on a camming member which is rotatable to predetermine the bias on said slideable member.

6. The system of claim 1, further comprising means defining at least one opening in a first side wall of said housing member, adapted to receive a bolt of a latching device.

7. The system of claim 6, wherein said rod comprises a pair of rod blocks slideably disposed in said housing member and connected by an offset rod connector so as to avoid obstruction of said opening.

8. The system of claim 7, further comprising means defining a plurality of slots in a second side wall of said housing member, said rod connector being disposed outside said housing member and attached to said rod blocks by means passing through said slots.

* * * * *